US009777731B2

(12) United States Patent
Bessel et al.

(10) Patent No.: US 9,777,731 B2
(45) Date of Patent: Oct. 3, 2017

(54) DUCT-MOUNTED SUCTION GAS FILTER

(71) Applicants: Kurt W. R. Bessel, Mexico, NY (US); Ronald J. Duppert, Fayetteville, NY (US); Bruce A. Fraser, Manlius, NY (US)

(72) Inventors: Kurt W. R. Bessel, Mexico, NY (US); Ronald J. Duppert, Fayetteville, NY (US); Bruce A. Fraser, Manlius, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 107 days.

(21) Appl. No.: 14/741,137

(22) Filed: Jun. 16, 2015

(65) Prior Publication Data

US 2016/0369803 A1 Dec. 22, 2016

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 2/00*** | (2006.01) |
| ***F04C 29/00*** | (2006.01) |
| ***F04C 18/02*** | (2006.01) |
| ***F04C 29/12*** | (2006.01) |
| ***F04C 29/02*** | (2006.01) |
| ***F04C 23/00*** | (2006.01) |

(52) U.S. Cl.

CPC ..... *F04C 29/0092* (2013.01); *F04C 18/0215* (2013.01); *F04C 23/008* (2013.01); *F04C 29/02* (2013.01); *F04C 29/026* (2013.01); *F04C 29/12* (2013.01); *F04C 2240/30* (2013.01); *F04C 2240/809* (2013.01)

(58) Field of Classification Search

CPC .... F04C 18/0215; F04C 23/008; F04C 29/02; F04C 29/023; F04C 29/026; F04C 29/12; F04C 2240/30; F04C 2240/809; F04C 29/0092; F01C 1/0215; F01C 21/04

USPC ..... 418/46–47, 88, 94, 55.1–55.6, 57, 270, 418/DIG. 1

See application file for complete search history.

(56) References Cited

U.S. PATENT DOCUMENTS 5,358,387 A 10/1994 Suzuki et al.
6,171,084 B1 1/2001 Wallis et al.
(Continued)

FOREIGN PATENT DOCUMENTS

WO WO 2013/142499 A1 9/2013

*Primary Examiner* — Theresa Trieu
(74) *Attorney, Agent, or Firm* — Reinhart Boerner Van Deuren P.C.

(57) ABSTRACT

A compressor for compressing fluid is provided. The compressor includes a housing having a housing inlet for receiving fluid and a housing outlet for discharging the fluid. A compressing mechanism is adapted to compress the fluid toward the housing outlet. The compressing mechanism is disposed in the housing. A drive unit is operatively connected to the compressing mechanism for driving the compressing mechanism to compress fluid. A suction duct is disposed in the housing. The suction duct extends vertically downward from the housing inlet toward a sump defined in the housing. The suction duct is configured for attachment to a motor housing. The suction duct has a duct inlet fluidically connected with the housing inlet, and defines a passage fluidically connecting the duct inlet with an interior cavity of the housing. A suction gas filter disposed in the suction duct, and having a filter screen positioned downstream of the duct inlet.

21 Claims, 13 Drawing Sheets

(56) References Cited

U.S. PATENT DOCUMENTS

| | | | |
|---|---|---|---|
| 6,398,530 | B1 | 6/2002 | Hasemann |
| 6,428,292 | B1 | 8/2002 | Wallis et al. |
| 6,582,211 | B2 | 6/2003 | Wallis et al. |
| 6,814,551 | B2 | 11/2004 | Kammhoff et al. |
| 6,960,070 | B2 | 11/2005 | Kammhoff et al. |
| 7,112,046 | B2 | 9/2006 | Kammhoff et al. |
| 7,997,877 | B2 | 8/2011 | Beagle et al. |
| 8,133,043 | B2 | 3/2012 | Duppert |
| 8,167,595 | B2 | 5/2012 | Duppert |
| 2002/0001531 | A1 | 1/2002 | Takahashi et al. |
| 2009/0169406 | A1 | 7/2009 | Ueno et al. |
| 2013/0248022 | A1 | 9/2013 | Roof |
| 2013/0251544 | A1 | 9/2013 | Duppert et al. |
| 2013/0251562 | A1 | 9/2013 | Roof et al. |
| 2014/0037483 | A1 | 2/2014 | Fraser et al. |

DUCT-MOUNTED SUCTION GAS FILTER

FIELD OF THE INVENTION

This invention generally relates to compressors, and, more specifically, to compressors with suction ducts.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; U.S. Pat. No. 7,112,046 to Kammhoff et al.; and U.S. Pat. No. 7,997,877, to Beagle et al., all of which are assigned to a Bitzer entity closely related to the present assignee. As the present disclosure pertains to improvements that can be implemented in these or other scroll compressor designs, the disclosures of U.S. Pat. Nos. 6,398,530, 7,112,046, 6,814,551, and 6,960,070 are hereby incorporated by reference in their entireties.

A scroll compressor having a suction duct is described in U.S. Pat. Nos. 8,133,043 and 8,167,595, both issued to Duppert; and U.S. Patent Pub. Nos. 2013/0248022 to Roof; 2013/0251562 to Roof et al.; and 2013/0251544 to Duppert et al., each of whose teachings and disclosures are incorporated by reference in their entireties. Additionally, particular embodiments of scroll compressors are disclosed in U.S. Pat. No. 6,582,211 to Wallis et al., U.S. Pat. No. 6,428,292 to Wallis et al., and U.S. Pat. No. 6,171,084 to Wallis et al., the teachings and disclosures of which are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purposes of compressing refrigerant. An appropriate drive unit, typically an electric motor, is provided usually within the same housing to drive the movable scroll member.

The present invention pertains to improvements in the state of the art. These and other advantages of the invention, as well as additional inventive features, will be apparent from the description of the invention provided herein.

BRIEF SUMMARY OF THE INVENTION

One inventive aspect is directed toward a scroll compressor in which a suction duct is provided in the housing to direct flow of refrigerant or other such fluid from the housing inlet into a desired location; that also includes at least one drain port that is arranged to drain lubricant received in the suction duct into the lubricant sump at the bottom of the scroll compressor housing. The drain port is advantageous in that the suction duct and the drain port thereof can be used for charging the lubricant sump in the housing through the inlet and/or to facilitate lubricant mist separation prior to gas flow into the motor shell in which the coalesced lubricant mist drains through the drain port into the lubricant sump.

In one aspect, embodiments of the invention provide a compressor for compressing fluid is provided. The compressor includes a housing having a housing inlet for receiving fluid and a housing outlet for discharging the fluid. A compressing mechanism is adapted to compress the fluid toward the housing outlet. The compressing mechanism is disposed in the housing. A drive unit is operatively connected to the compressing mechanism for driving the compressing mechanism to compress fluid. A suction duct is disposed in the housing. The suction duct extends vertically downward from the housing inlet toward a sump defined in the housing. The suction duct is configured for attachment to a motor housing. The suction duct has a duct inlet fluidically connected with the housing inlet. The suction duct defines a passage fluidically connecting the duct inlet with an interior cavity of the housing. A suction gas filter disposed in the suction duct, and having a filter screen positioned downstream of the duct inlet. In certain embodiments, the suction gas filter is arranged between the inlet opening and a motor housing opening.

In a particular embodiment, the suction duct has an outer generally rectangular and arcuate mounting flange surrounding a duct channel that has been pressed into the body and extends between a top end and a bottom end. The duct channel and mounting flange define the interior volume. The filter screen has a perimeter which is attached to the mounting flange such that a fluid flowing through the duct inlet to the compressing mechanism must pass through the filter screen when the suction duct is attached to the motor housing.

The filter screen may be pre-formed such that the perimeter of the filter screen matches contours of the mounting flange. In some embodiments, the filter screen extends laterally across the entire width of the duct channel, and extends longitudinally across the entire length of the duct channel such that the filter screen divides an interior volume of the suction duct into two smaller volumes. In a more particular embodiment, the filter screen diagonally divides at least a portion of the interior volume of the suction duct. The filter screen may be sealingly attached, along its perimeter, to the duct channel of the suction duct.

In a particular embodiment, the filter screen extends across the length and width of the duct channel, and runs parallel to a channel bottom of the suction duct. In some embodiments, the filter screen extends across the width of the duct channel and across a portion of the duct channel length such that the filter screen divides an interior volume of the suction duct into two smaller volumes. In other embodiments, the filter screen is cup-shaped and has a rim that is attached to the duct channel. A portion of the rim abuts the motor housing when the suction duct is attached to the motor housing.

The filter screen may also include a cylindrical screen member having a vertically-extending axis. In some embodiments, a partition extends laterally across an interior volume of the suction duct. The partition extends to the motor housing. The partition divides the interior volume into an inlet region that includes the duct inlet, and an outlet region. The suction gas filter extends into the outlet region, and the partition defines an opening in the filter inlet. In certain embodiments, the cylindrical screen member has an inlet end and an outlet end, with an open end at the inlet end and a closed end cap at the outlet end. The suction gas filter may have an opening defined by an opening in the partition.

In some embodiments, the compressor is a scroll compressor having an output of at least 0.2 cubic meters per minute, and wherein the suction gas filter comprises a screen body with pores of between 0.25 and 2.0 square millimeters, the screen body having an effective screen area of greater than 75 square centimeters. In an alternate embodiment of the invention, the compressor is a scroll compressor having an output of at least 0.2 cubic meters per minute, and the suction gas filter has a mesh screen body with pores, or openings, of between 1.0 and 2.0 square millimeters, the screen body having an effective screen area of greater than 150 square centimeters.

The filter screen may be either rectangular or trapezoidal, such that the perimeter of the filter screen has four sides. Furthermore, the filter screen may extend at least 75% of an overall length of the suction duct. In some embodiments, the filter screen is pre-formed such that the perimeter of the filter screen matches the contours of the suction duct where the perimeter is sealingly attached to the duct channel and mounting flange. In a more particular embodiment, the filter screen diagonally bisects the duct channel.

In another aspect, embodiments of the invention provide a compressor for compressing a fluid. The compressor includes a housing having an inlet for receiving fluid and an outlet for discharging the fluid. A compressing mechanism is adapted to compress the fluid toward the outlet. The compressing mechanism is disposed in the housing. A drive unit is operatively connected to the compressing mechanism for driving the compressing mechanism to compress fluid. A suction duct is disposed in the housing. The suction duct has an inlet opening aligned with the housing inlet. A suction gas filter is arranged to enclose a volume. The suction gas filter is arranged to receive, into the enclosed volume, the fluid flowing into the inlet.

In a particular embodiment, the suction gas filter has a longitudinal axis that is parallel to a longitudinal axis of the suction duct. In a more particular embodiment, the longitudinal axes of the suction duct and suction gas filter are parallel to a longitudinal axis of the compressor. The suction duct may include a partition that divides the interior of the suction duct into two separation sections, where the partition is arranged perpendicular to the longitudinal axis of the suction gas filter, wherein the suction gas filter is disposed on one side of the partition. In certain embodiments, the suction gas filter has an opening defined by an opening in the partition. The suction gas filter may comprise a metal screen.

In a further embodiment, the enclosed volume is a cylindrical enclosed volume. In an alternate embodiment, the enclosed volume is a substantially prism-shaped enclosed volume. In a particular embodiment, the suction gas filter is attached to an interior surface of the suction duct. In a particular embodiment, the compressor is a scroll compressor with scroll bodies having respective bases and respective scroll ribs that project from the respective bases and which mutually engage about an axis for compressing fluid.

Yet another aspect of the present invention is a suction duct that is adapted for mounting in a compressor housing comprising a stamped sheet steel metal body having an outer generally rectangular and arcuate mounting flange surrounding a duct channel that has been pressed into the body and extends between a top end and a bottom end. An inlet opening is formed through a bottom of the duct channel proximate the top end. A drain port is formed proximate a bottom end.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
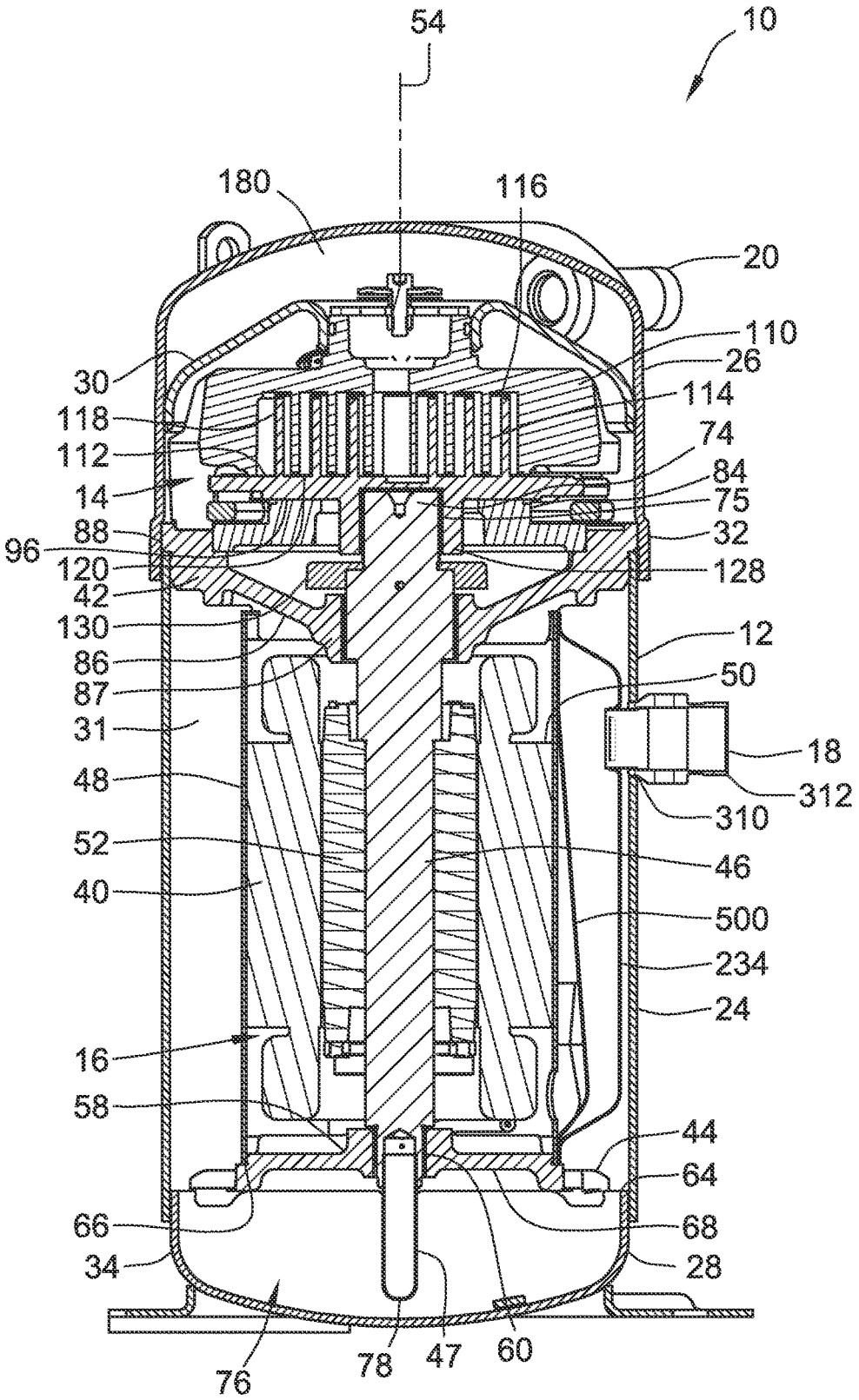
FIG. 1 is a cross-sectional isometric view of a scroll compressor assembly, according to an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high-pressure state. The scroll compressor assembly 10 receives low-pressure refrigerant at the refrigerant inlet port 18 and compresses the refrigerant for delivery to a high-pressure chamber 180 where it can be discharged through the refrigerant outlet port 20.

The outer housing 12 for the scroll compressor assembly 10 may take many forms. In particular embodiments of the invention, the outer housing 12 includes multiple shell sections. In the embodiment of FIG. 1, the outer housing 12 includes a central cylindrical housing section 24, and a top end housing section 26, and a bottom end housing section 28 that serves as a mounting base. In certain embodiments, the housing sections 24, 26, 28 are formed of appropriate sheet steel and welded together to make a permanent outer housing 12 enclosure. However, if disassembly of the housing is desired, other housing assembly provisions can be made that can include metal castings or machined components, wherein the housing sections 24, 26, 28 are attached using fasteners.

As can be seen in the embodiment of FIG. 1, the central housing section 24 is cylindrical, joined with the top end housing section 26. In this embodiment, a separator in the form of separator plate 30 is disposed in the top end housing section 26. During assembly, these components can be assembled such that a single circumferential weld around the inner surface of the outer housing 12 joins the top end housing section 26 and the separator plate 30. A second circumferential weld may externally join the top end housing section 26 and central cylindrical housing section 24. In particular embodiments, the central cylindrical housing section 24 is welded to the single-piece bottom shell 28, though, as stated above, alternate embodiments would include other methods of joining (e.g., fasteners) these sections of the outer housing 12.

Assembly of the outer housing 12 results in the formation of an enclosed chamber 31 that surrounds the drive unit 16, and partially surrounds the scroll compressor 14. In particular embodiments, the top end housing section 26 is generally dome-shaped and includes a respective cylindrical side wall region 32 that fits telescopically with the top of the central cylindrical housing section 24, and provides for closing off the top end of the outer housing 12. As can also be seen from FIG. 1, the bottom of the central cylindrical housing section 24 fits telescopically with a cylindrical sidewall region 34 of the bottom end housing section 28. In at least one embodiment of the invention, the central cylindrical housing section 24 and bottom end housing section 28 are joined by an exterior weld around the circumference of a bottom end of the outer housing 12.

In a particular embodiment, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via an adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearing members 42, 44. Energizing the stator 50 is operative to rotatably drive the rotor 52 and thereby rotate the drive shaft 46 about a central axis 54.

Applicant notes that when the terms "axial" and "radial" are used herein to describe features of components or assemblies, they are defined with respect to the central axis 54. Specifically, the term "axial" or "axially-extending" refers to a feature that projects or extends in a direction generally parallel to the central axis 54, while the terms "radial" or "radially-extending" indicates a feature that projects or extends in a direction generally perpendicular to the central axis 54. Some minor variation from parallel and perpendicular is permissible.

With reference to FIG. 1, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the cylindrical hub 58, and serves to separate a lower portion of the stator 50 from an oil lubricant sump 76. In an embodiment of the invention, the lower bearing member 44 may rest on the top face 64 of the bottom end housing section 28. The lower bearing member 44 is, in turn, centered radially at the lower end opening 66 of the stator housing 48.

In the embodiment of FIG. 1, the drive shaft 46 has an impeller tube 47 attached at the bottom end of the drive shaft 46. In a particular embodiment, the impeller tube 47 is of a smaller diameter than the drive shaft 46 and is aligned concentrically with the central axis 54. As can be seen from FIG. 1, the drive shaft 46 and impeller tube 47 pass through an opening in the cylindrical hub 58 of the lower bearing member 44. At its upper end, the drive shaft 46 is journaled for rotation within the upper bearing member 42. Upper bearing member 42 may also be referred to as a "crankcase."

The drive shaft 46 further includes an offset eccentric drive section 74 that has a cylindrical drive surface 75 (shown in FIG. 2) about an offset axis that is offset relative to the central axis 54. This offset drive section 74 is journaled within a cavity of a movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which suitable oil lubricant is provided. The impeller tube 47 has an oil lubricant passage and inlet port 78 formed at the end of the impeller tube 47. Together, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be desired.

Figure 2:
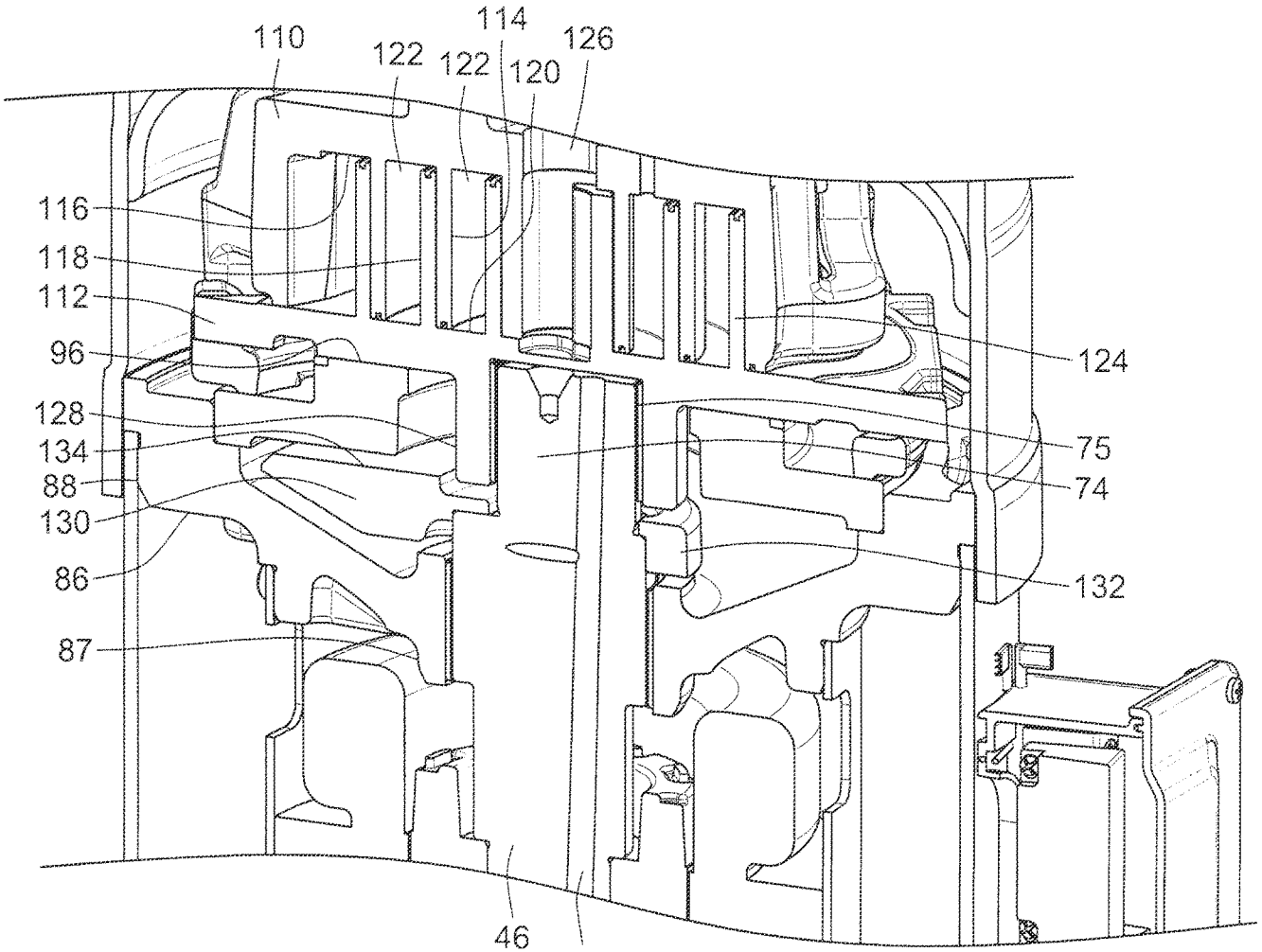
FIG. 2 is a cross-sectional isometric view of an upper portion of the scroll compressor assembly of FIG. 1.
Figure 3:
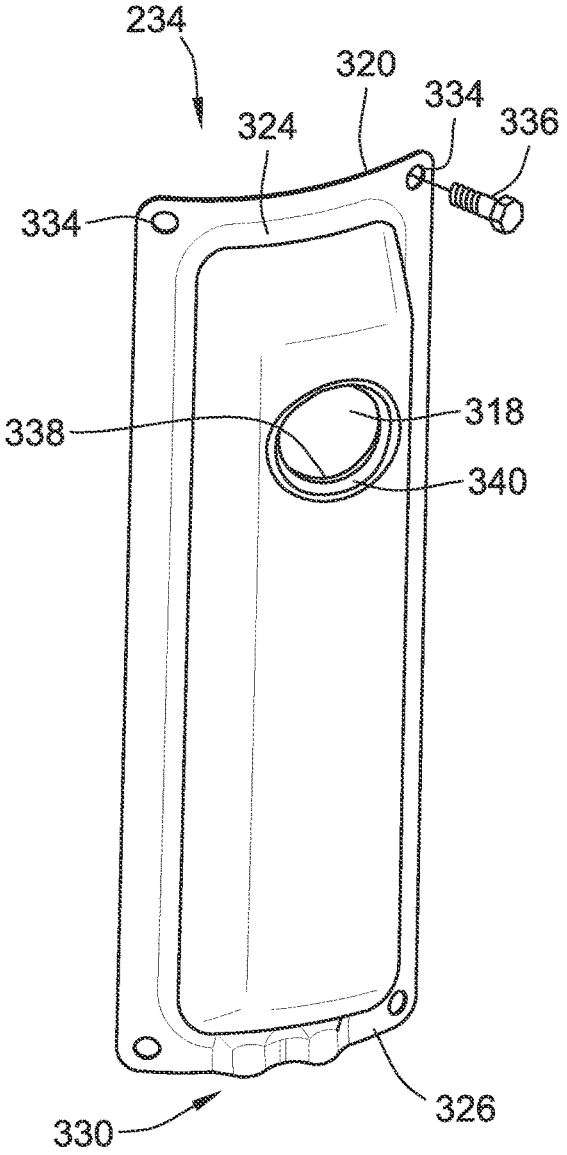
FIGS. 3 and 4 are isometric views of different sides of the suction duct employed in the scroll compressor assembly of the previous figures, before the assembly of the duct-mounted suction gas filter.
Figure 4:
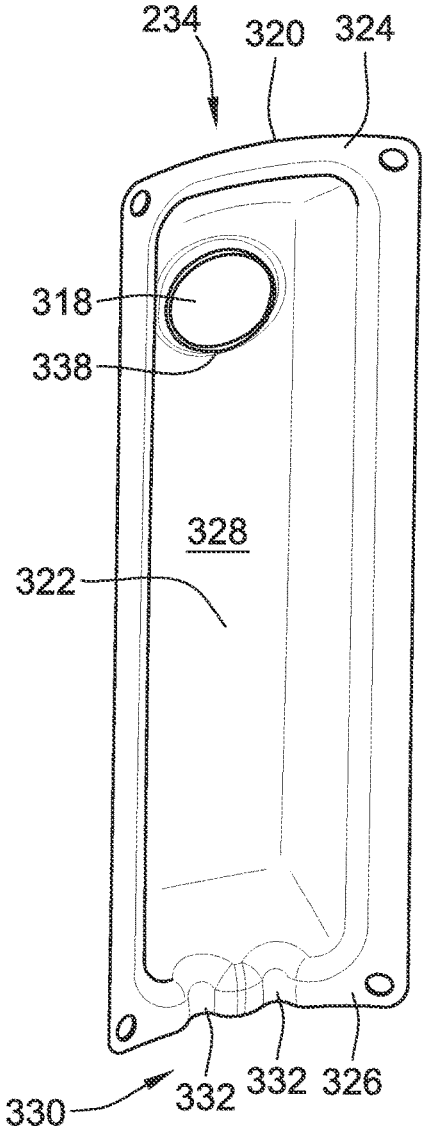
Figure 5:
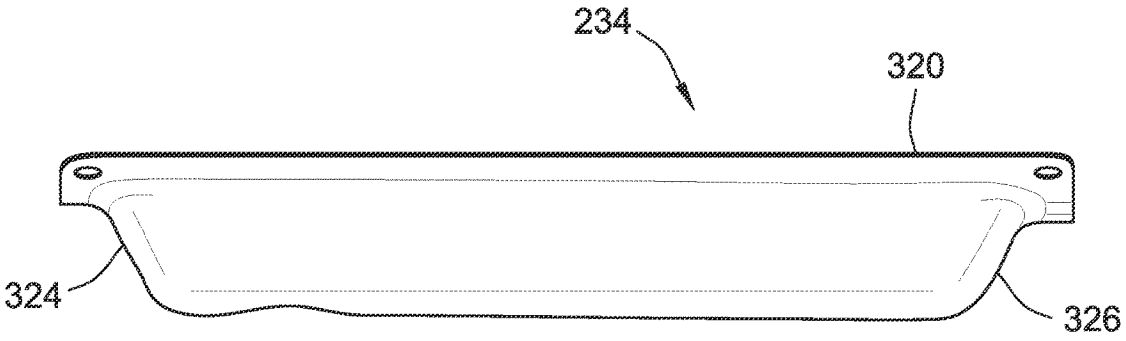
FIG. 5 is a side elevation view of the suction ducts shown in FIGS. 3 and 4.
Figure 6:
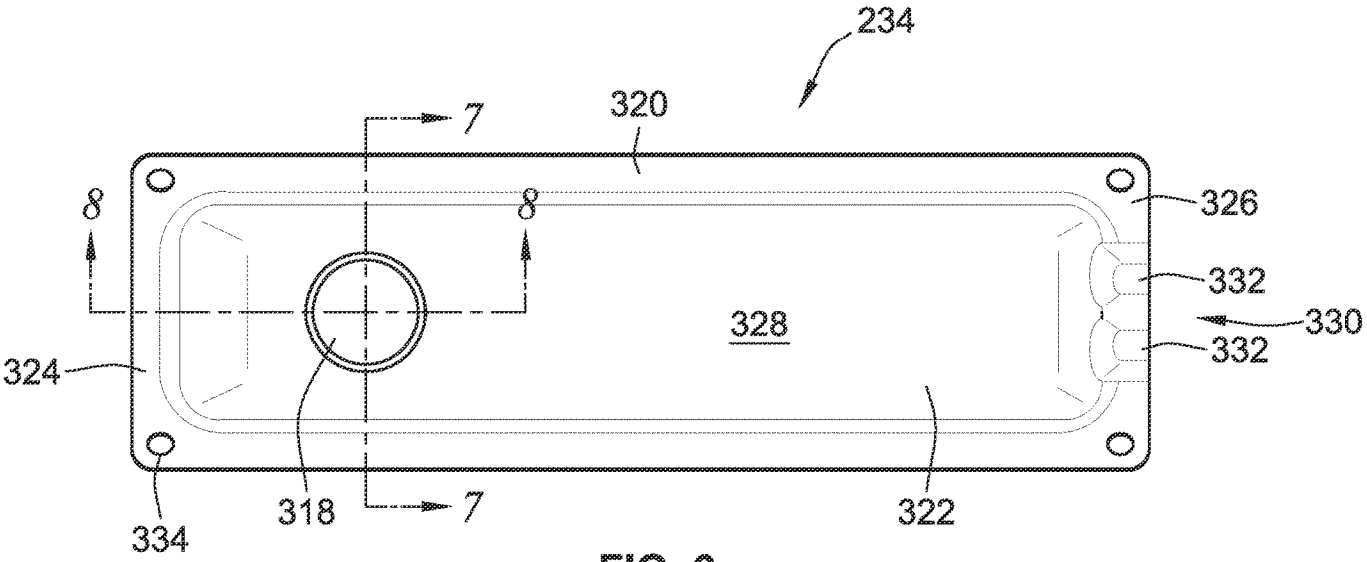
FIG. 6 is a plan view of the suction duct shown in FIG. 5.
Figure 7:
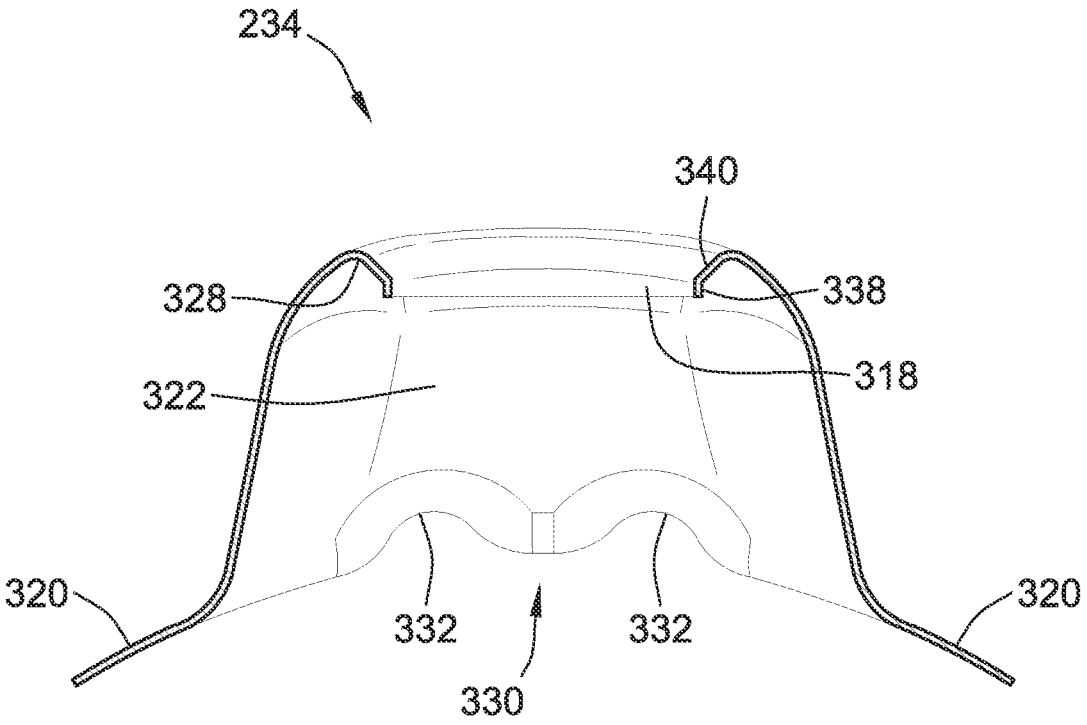
FIGS. 7 and 8 are cross sections of the suction duct taken about lines 9-9 and 10-10, respectively in FIG. 6.
Figure 8:
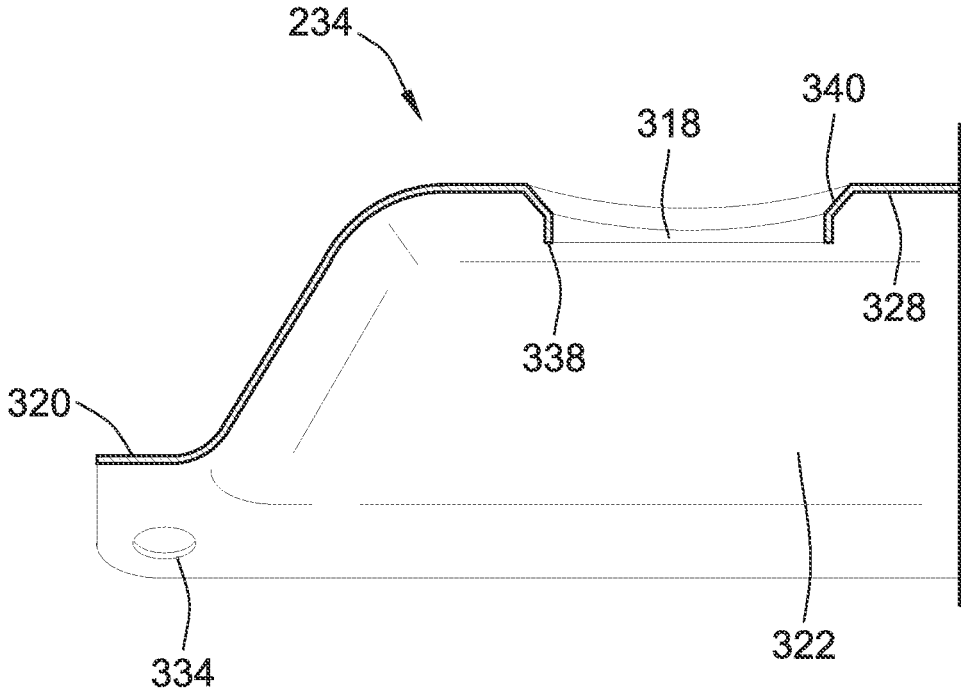

The upper bearing member 42, or crankcase, includes a central bearing hub 87 into which the drive shaft 46 is journaled for rotation. Extending outward from the central bearing hub 87 is a disk-like portion 86 that terminates in an intermittent perimeter support surface 88. In the embodiments of FIGS. 1 and 2, the central bearing hub 87 extends below the disk-like portion 86, while a thrust bearing 84 is assembled above the disk-like portion 86 and contains a thrust surface 96, which provides axial support for the moveable scroll compressor body 112. In certain embodiments, the intermittent perimeter support surface 88 is adapted to have an interference and press-fit with the outer housing 12. It is understood that particular embodiments of the invention may include crankcase posts with threaded holes to receive fasteners for assembly. Alternate embodiments of the invention also include those in which the posts are integral with a pilot ring instead of the crankcase 42.

Turning in greater detail to the scroll compressor 14, the scroll compressor 14 includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first scroll rib 114 projecting axially from a plate-like base 116 and is designed in the form of a spiral. Similarly, the movable scroll compressor body 112 includes a second scroll rib 118 projecting axially from a plate-like base 120 and is in the shape of a similar spiral. The scroll ribs 114, 118 engage in one another and abut sealingly on the respective surfaces of bases 120, 116 of the respectively other scroll compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 1-2). Following the progressive compression in the chambers 122 (as the chambers progressively are defined radially inward), the refrigerant exits via a compression outlet 126 that is defined centrally within the base 116 of the fixed scroll compressor body 110. Refrigerant that has been compressed to a high pressure can exit the chambers 122 via the compression outlet 126 during operation of the scroll compressor 14.

The movable scroll compressor body 112 engages the eccentric offset drive section 74 of the drive shaft 46. More specifically, the receiving portion of the movable scroll compressor body 112 includes the cylindrical bushing drive hub 128 which slideably receives the eccentric offset drive section 74 with a slideable bearing surface provided therein. In detail, the eccentric offset drive section 74 engages the cylindrical bushing drive hub 128 in order to move the movable scroll compressor body 112 about an orbital path about the central axis 54 during rotation of the drive shaft 46 about the central axis 54.

Considering that this offset relationship causes a weight imbalance relative to the central axis 54, the assembly typically includes a counterweight 130 that is mounted at a fixed angular orientation to the drive shaft 46. The counterweight 130 acts to offset the weight imbalance caused by the eccentric offset drive section 74 and the movable scroll compressor body 112 that is driven about an orbital path. The counterweight 130 includes an attachment collar 132 and an offset weight region 134 that provides for the counterweight effect and thereby balancing of the overall weight of the components rotating about the central axis 54. This provides for reduced vibration and noise of the overall assembly by internally balancing or cancelling out inertial forces.

Referring to FIG. 1, it is seen that a suction duct 234 is preferably employed to direct incoming fluid flow (e.g. refrigerant) through the enclosed chamber 31 within the outer housing 12, from the refrigerant inlet port 18 to a point proximate the lower end of the electrical motor 40. To provide for the inlet 18, the housing 12 includes an inlet opening 310 in the compressor housing 12 in which an inlet fitting 312 is provided that includes a connector such as threads, barb or quick-connect coupler, for example. The inlet fitting 312 may be welded to the outer housing 12 in engagement with the inlet opening 310. The inlet opening 310 and the inlet fitting 312 are thereby provided for communicating the refrigerant into the housing 12.

Turning in greater detail to the suction duct 234, and referring to FIGS. 3-8, it is seen that the suction duct comprises a stamped sheet steel metal body having a constant wall thickness with an outer generally rectangular and arcuate mounting flange 320 which surrounds a duct channel 322 that extends between a top end 324 and a bottom end 326. The duct inlet 318 is formed through a channel bottom 328 proximate the top end 324. This duct inlet 318 provides a means for communicating and receiving fluid from the inlet. The duct channel 322 provides a fluid flow path to a drain port 330 proximate the bottom end 326 as shown in the figures.

In an embodiment, the drain port 330 extends through the bottom end 326 and thereby provides a port for draining lubricant oil into the lubricant sump (see e.g. 76 in FIG. 1). Preferably, the drain port 330 is provided by at least one and typically two or more recessed grooves 332 that connect the duct channel 322 toward the lubricant sump. The recessed grooves 332 are formed into the rectangular mounting flange 320 and extend substantially vertically and axially to provide for axial and/or vertical flow as opposed to circumferential or radial flow.

With reference to FIGS. 3-8, the mounting flange 320 is generally rectangular and arcuate about an axis to surround the duct channel 322 and abuts the exterior surface of the motor housing 48. It further comprises fasteners sockets in the form of holes 334 proximate the corners of the mounting flange 320 such that fasteners 336 may be used to fasten and thereby secure the mounting flange 320 to the motor housing 48. Preferably, the suction duct is a metal stamping of sheet metal to provide the body and wall structure of the suction duct 234 as a unitary member. The rectangular and arcuate mounting flange 320 and the duct channel 322 can readily be stamped into the sheet metal to provide an elongated duct channel 322 and bottom grooves 332 as well as the fastener holes 334. The duct inlet 318 is also formed by stamping and punching out the generally circular disk from the sheet metal. Material stamp forming of the punched out area creates an annular opening flange 338 defining the duct inlet 318, which projects from the channel bottom 328 toward the mounting flange 320. As shown, the annular opening flange 338 tapers as it extends radially inward and away from the channel bottom 328 so as to provide a tapered guide surface 340.

During operation, the scroll compressor assembly 10 is operable to receive low pressure refrigerant at the housing inlet port 18 and compress the refrigerant for delivery to the high pressure chamber 180 where it can be output through the housing outlet port 20. As is shown, in FIG. 1, a suction duct 234 is connected internally of the housing 12 to guide the lower pressure refrigerant from the inlet port 18 through the enclosed chamber 31, and to the motor housing 48 where it subsequently passes through the housing, en route to the scroll compressor 14 for eventual compression and discharge. FIG. 1 shows duct-mounted suction gas filter 500, in suction duct 234. The suction gas filter 500 extends laterally across the width of the suction duct 234 and diagonally along the length of the suction duct 234. Various embodiments of duct-mounted suction gas filters are discussed in more detail below with respect to FIGS. 9-21. Each of these duct-mounted suction gas filters is designed allow the low-pressure refrigerant to flow, with less pressure drop than in conventional gas filters, through and across the motor 40 and thereby cool and carry heat away from the motor 40 which can be caused by operation of the motor 40. The filtered, low-pressure refrigerant can then pass longitudinally through the motor housing 48 and around through void spaces therein toward the top end or the motor housing 48, where it can exit therefrom.

In an embodiment of the present invention, not only does the suction duct 234 direct substantially all of the refrigerant from the inlet 18 to a location upstream of the motor 40 and through the motor 40, but it also acts as a gravitational drain preferably by incorporating one or multiple drain ports 330 at the absolute gravitational bottom of the suction duct 234 or proximate thereto so as to drain lubricant received in the suction duct 234 into the lubricant sump 76. This can be advantageous for several reasons. First, when it is desirable to fill the lubricant sump 76 either at initial charging or otherwise, oil can readily be added through the inlet 18 which acts also as an oil fill port as oil will naturally drain through the suction duct 234 and into the oil sump 76 through the drain port 330. The housing 12 can thereby be free of a separate oil port. Additionally, the surfaces of the suction duct 234 and redirection of oil therein causes coalescing of oil lubricant mist which can then collect within the duct channel 322 and drain through the drain port 330 back into the oil sump 76. Thus, direction of refrigerant as well as direction of lubricant oil is achieved with the suction duct 234.

Figure 9:
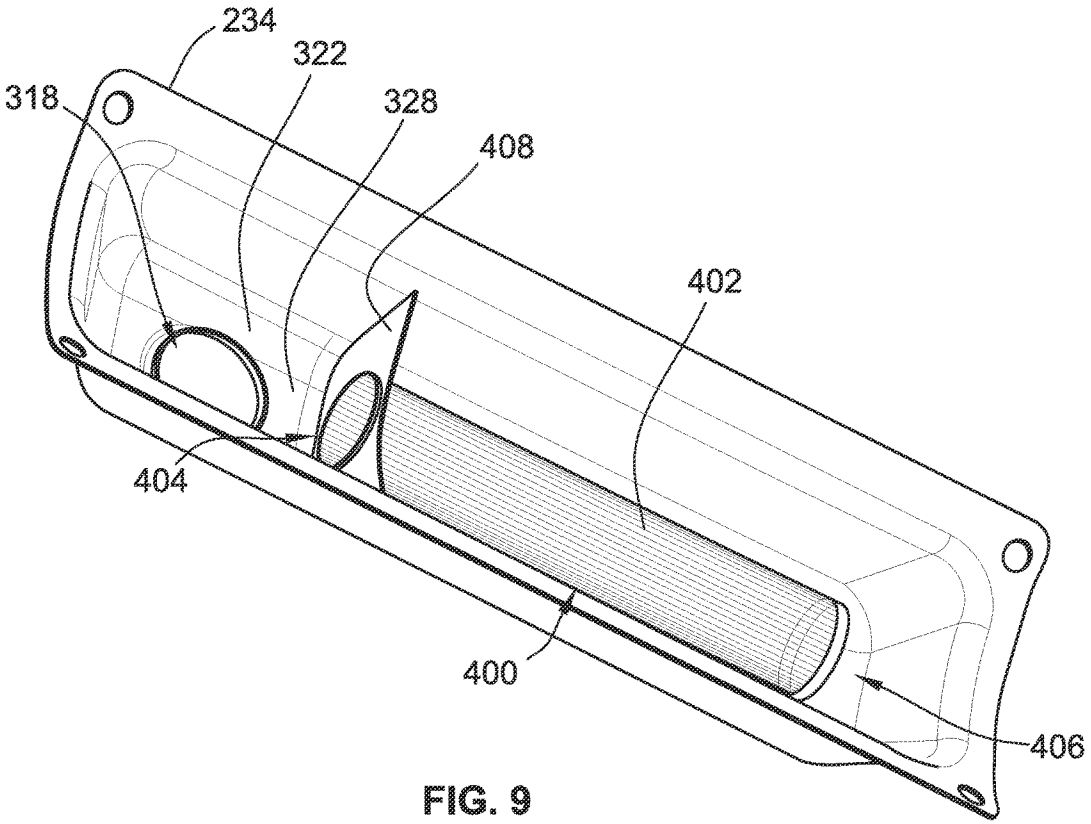
FIG. 9 is a perspective view of a duct-mounted suction gas filter, according to an embodiment of the invention.
Figure 10:
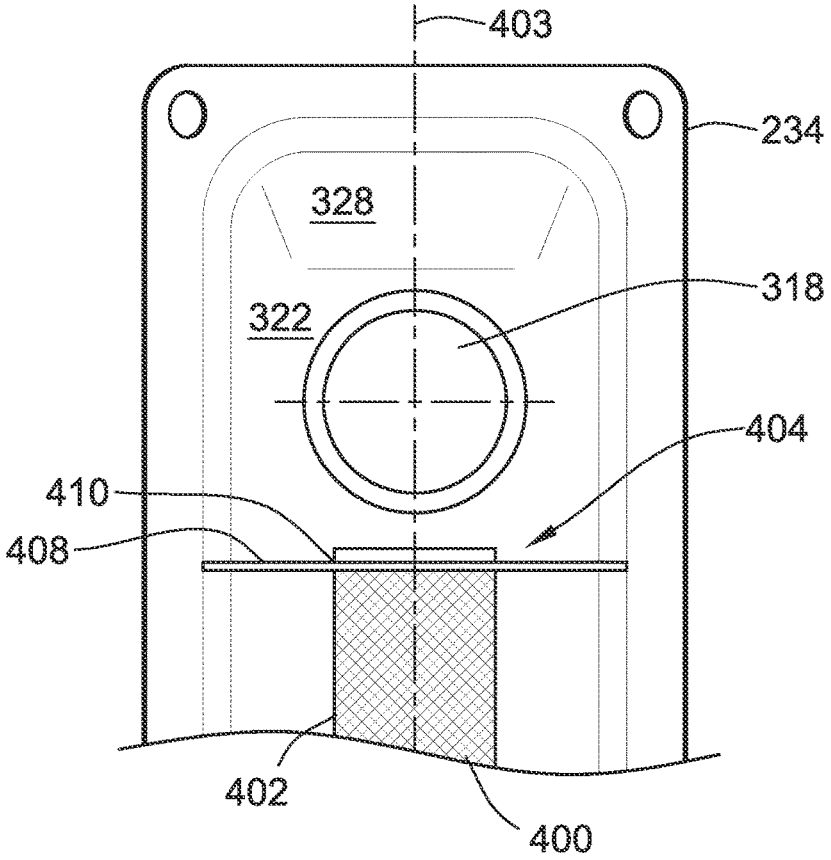
FIG. 10 is a partial plan view of the suction duct with duct-mounted suction gas filter shown in FIG. 9.
Figure 11:
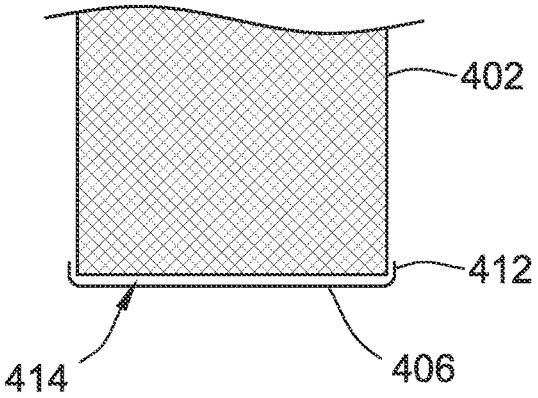
FIG. 11 is a partial plan view of the closed end of the suction duct from the duct-mounted suction gas filter of FIGS. 9 and 10.

FIG. 9 shows a perspective view of the duct-mounted suction gas filter 400, according to an embodiment of the invention. In particular embodiments, the duct-mounted suction gas filter 400 is attached to a surface of the duct channel 322, for example the channel bottom 328. The duct-mounted suction gas filter 400 may be attached to the duct channel in any number of ways, including, but no limited to, welding, mechanical fastening, adhesive attachment, etc. The duct-mounted suction gas filter 400 is configured to enclose, or partially enclose, a three-dimensional volume. In the embodiment of FIGS. 9-11, the duct-mounted suction gas filter 400 includes a cylindrical mesh screen 402. In alternate embodiments, the duct-mounted suction gas filter 400 has a prism-shaped mesh screen. Other three-dimensional shapes for the duct-mounted suction gas filter 400 are also envisioned.

In certain embodiments, the cylindrical mesh screen 402 has a longitudinal axis 403 (shown in the partial plan view of FIG. 10) that is parallel to a longitudinal axis of the suction duct 234. In a more particular embodiment, the longitudinal axes of the suction duct 234 and suction gas filter 400 are parallel to the central axis 54 of the compressor. The cylindrical mesh screen 402 has a filter inlet 404 at an open end of the suction gas filter 400 proximate the duct inlet 318 of the suction duct 234. Opposite the filter inlet 404 is a closed end mesh screen 406. The closed end mesh screen 406 may be attached to the cylindrical mesh screen 402 using adhesives, by welding, or other suitable means of attachment.

FIG. 11 is a plan view of the bottom portion of the cylindrical mesh screen 402 with closed end mesh screen 406. The closed end mesh screen 406 may be configured as an end cap, with a perimeter portion 412 that wraps around to enclose an end 414 of the cylindrical mesh screen 402. During assembly, adhesive may be placed in the perimeter portion 412 before the cylindrical mesh screen 402 is assembled to the closed end mesh screen 406. Alternatively, the end 414 of the cylindrical mesh screen 402 could be welded to the perimeter portion 412. One of skill in the art will recognize that the aforementioned end cap configuration of the closed end mesh screen 406 may be constructed in a variety of shapes to work with mesh screens having shapes other than that of a cylinder. Further, it is understood that configurations of the closed end mesh screen 406 other than as an end cap are also within the scope of the present invention.

The shape and size of the duct-mounted suction gas filter 400 allow for more refrigerant gas to pass-through the filter 400, resulting in less restriction and little loss of pressure. Increasing the length, and therefore the surface area, of the suction gas filter 400 along the path of the gas flow provides the geometry allowing for more filter surface area, thus reducing the pressure drop as compared to conventional compressors. For example, in conventional compressors, the suction gas filter is typically deployed to filter the refrigerant flow immediately upon entering the compressor housing. In this way, the internal components of the compressor restrict the scale of the filter. However, by moving the suction gas filter 400 into the suction duct 234, which is aligned parallel to the compressor, the size, i.e., the surface area, of the suction gas filter 400 may be increased to provide an increased flow of refrigerant gas, and a corresponding reduction in the pressure drop.

In certain embodiments, the suction duct 234 has a duct inlet 318 fluidically connected with the housing inlet opening 310. The suction duct 234 defines a passage fluidically connecting the duct inlet 318 with an interior cavity of the housing 12. The suction gas filter 400 has a filter inlet 404 positioned downstream of the duct inlet 318.

In a particular embodiment, the suction duct 234 extends vertically downward from the inlet opening 310 toward the lubricant sump 76. In particular embodiments, the suction gas filter 400 includes a cylindrical, prism-shaped, or other suitably shaped screen member 402 surrounding a vertically extending axis, when installed in the scroll compressor assembly 10. In a more particular embodiment, the suction gas filter 400 extends at least 50% of a length of the duct channel 322.

In the embodiment of FIGS. 9 and 10, a partition 408 extends laterally across the duct channel 322. The partition 408 may be attached to the duct channel 322 by welding, using adhesives, or by any other suitable means between the partition 408 and suction duct 234. The partition 408 divides the interior of the suction duct 234 into two separation sections, such that the partition 408 is arranged perpendicular to a longitudinal axis 403 (shown in FIG. 10) of the suction gas filter 400. As shown in FIG. 9, the suction gas filter 400 is disposed on one side of the partition 408. The partition 408 is configured to prevent the flow of refrigerant gas through the suction duct 234, except through the suction gas filter 400 through filter inlet 404.

The partition 408 has an opening that receives, in sealing engagement, the filter inlet 404 of the suction gas filter 400.

The seal between the partition 408 and filter inlet 404 may be created by a weld at joint 410 joining the two parts, or by an adhesive applied at joint 410. Thus, suction gas, flowing into the compressor, flows through the duct inlet 318 of suction duct 234 and through the suction gas filter 400 via filter inlet 404. Any particulates in the suction gas are trapped by the mesh screen 402, 406. Gravity will cause most particulate matter to settle in the bottom of the suction gas filter 400 at closed end 406.

In a particular embodiment of the invention, the suction gas filter 400 has a length along its longitudinal axis 403, and a width or diameter perpendicular to its longitudinal axis 403. In some embodiments, the length-to-diameter ratio is greater than 2:1. In another embodiment, the length-to-diameter ratio is greater than 4:1.

In some embodiments, the compressor is a scroll compressor having an output of at least 0.2 cubic meters per minute, and the suction gas filter 400 will include a mesh screen body 402, 406 with pores, or openings, of between 0.25 and 2.0 square millimeters. In this embodiment, the mesh screen body 402 and closed end mesh screen 406 has an effective screen area of greater than 75 square centimeters. In an alternate embodiment of the invention, the compressor is a scroll compressor having an output of at least 0.2 cubic meters per minute, and the suction gas filter 400 has a mesh screen body 402, 406 with pores, or openings, of between 1.0 and 2.0 square millimeters. In this particular embodiment, the mesh screen body 402 and closed end mesh screen 406 has an effective screen area of greater than 150 square centimeters.

Figure 12:
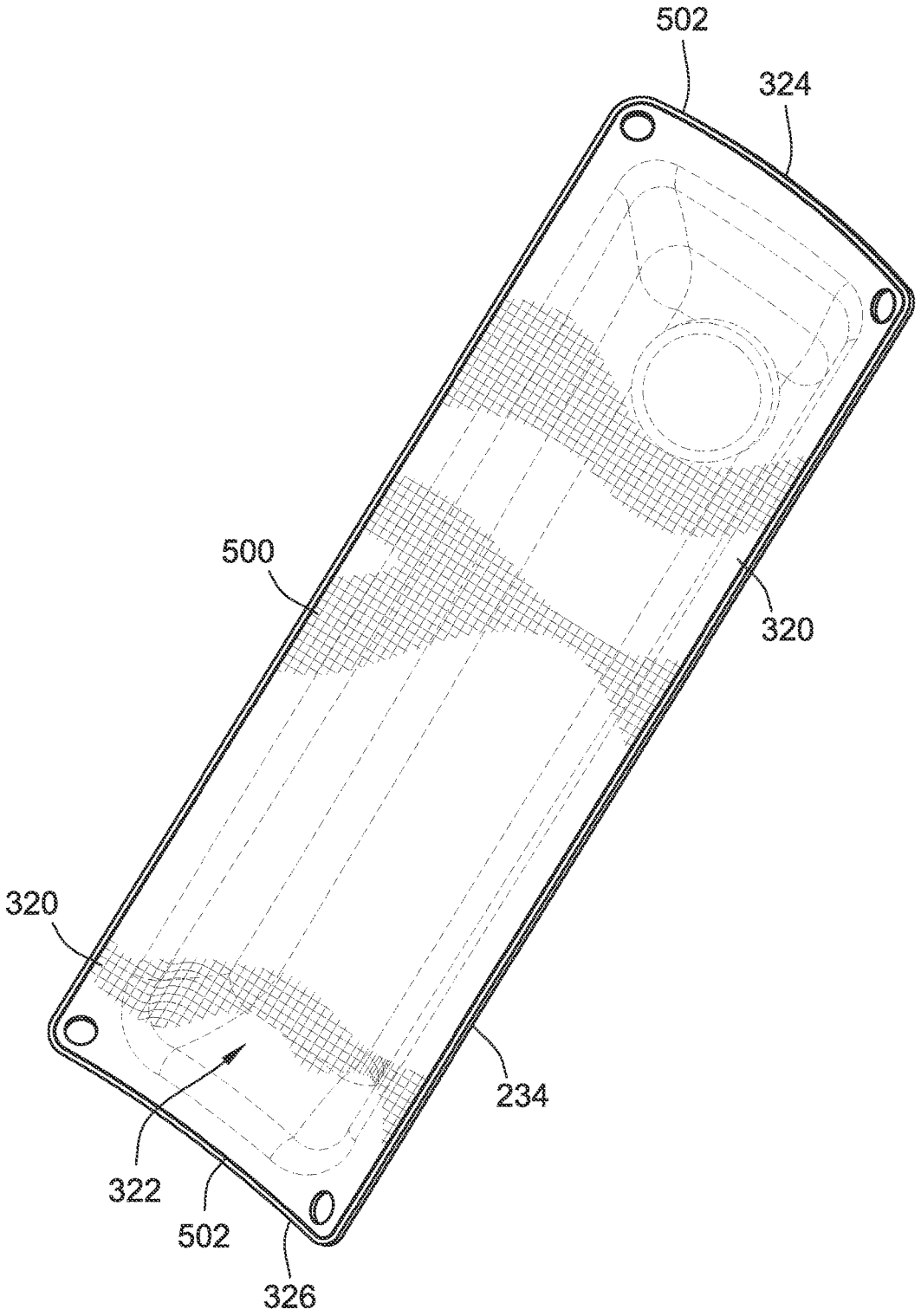
FIG. 12 is a perspective view of a duct-mounted suction gas filter different from that shown in FIG. 9, according to an embodiment of the invention.
Figure 13:
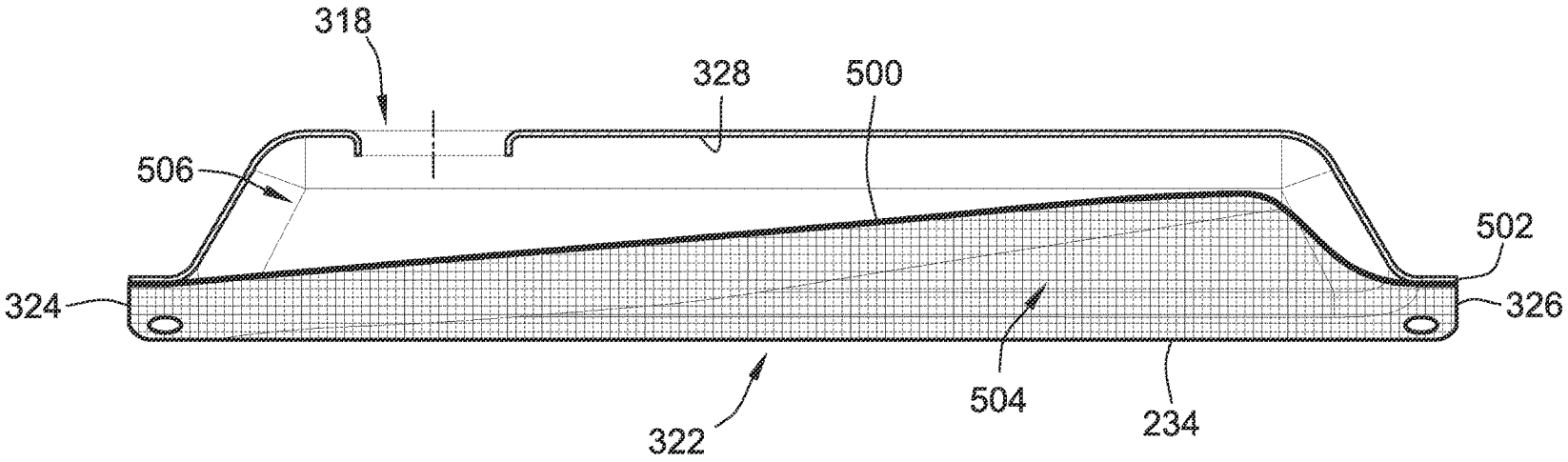
FIG. 13 is a cross-sectional side view of the duct-mounted suction gas filter of FIG. 12.

FIGS. 12 and 13 disclose an alternate embodiment of the suction duct 234 and integral suction gas filter. FIG. 12 shows a perspective view of the suction duct 234 and suction gas filter, while FIG. 13 shows a cross-sectional side view of the same suction duct 234 and suction gas filter. The suction gas filter comprises a filter screen 500 positioned downstream of the duct inlet 318. Thus, any solid impurities in the refrigerant gas entering the suction duct 234 through the duct inlet 318 will be filtered out by filter screen 500 before entering the motor housing 48 on the way to the compressing mechanism.

In a particular embodiment, the filter screen 500 is stamped into the shape shown in FIGS. 12 and 13. The filter screen 500 extends laterally across the width of the suction duct 234, and extends longitudinally at an angle along the entire length of the suction duct 234 such that the filter screen 500 divides an interior volume of the suction duct 234 into two smaller volumes 504, 506. More specifically, in the embodiment shown in FIGS. 12 and 13, the filter screen 500 is contoured as a ramp with the duct channel 322, and diagonally bisects the duct channel 322 along a longitudinal length of the suction duct 234.

In certain embodiments, the suction duct 234 has an outer generally rectangular and arcuate mounting flange 320 surrounding a duct channel 322 that has been formed into the body of the suction duct 234, and extends between a top end and a bottom end of the suction duct 234. The duct channel 322 and mounting flange 320 define the interior volume, and the filter screen 500 has a perimeter 502, which is sealingly attached to the duct channel 322 and mounting flange 320 such that a fluid flowing through the duct inlet 318 to the compressing mechanism must pass through the filter screen 500. Arranging the filter screen 500 in the angled orientation shown allows for the entire screen to filter the refrigerant gas before it passes through a relatively smaller opening in the motor housing 48. The greater filter screen area results in a smaller pressure drop and increased refrigerant flow rate than with many conventional suction duct filters.

In the embodiment shown, the filter screen 500 is either rectangular or substantially rectangular, but with an arcuate shape corresponding to that of the suction duct 234. This allows the perimeter 502 of the filter screen 500 to be attached to the four sides of the generally rectangular and arcuate mounting flange 320. In some embodiments, the filter screen 500 is pre-formed, for example by the aforementioned stamping process, such that the perimeter 502 of the filter screen 500 matches the contours of the suction duct 234 where the perimeter 502 is sealingly attached to the duct channel and mounting flange 320. Additionally, the filter screen material may be sufficiently rigid that, once stamped, the shape of the filter screen 500 does not change.

For example, the filter screen 500 may be formed into a three-dimensional contour using the aforementioned stamping process to shape the filter screen 500 so that it can be nested within the duct channel 322 and along a portion of the mounting flange 320. Further, the stamped shape of the filter screen 500 allows for its use with suction ducts 234 of various depths and channel contours, as long as the shape of the mounting flange 320 matches that of the filter screen 500.

The sealing attachment of the filter screen 500 to the suction duct 234 may be accomplished in several ways. The seal should be such that contaminants in the refrigerant gas should not be able to pass through the area of attachment. In certain embodiments, an adhesive is used to attach the perimeter 502 of the filter screen 500 to a portion of the mounting flange 320 and to an interior portion of the duct channel 322. In embodiments where the filter screen 500 is made from metal, welding, brazing, or soldering may be used to create the sealing attachment. A tack weld may be used to attach he perimeter 502 of the filter screen 500 to a portion of the mounting flange 320 at a spot on each of the four sides of the suction duct 234, or just on two opposite sides. In this way, the actual seal is created by the attachment of the mounting flange 320 to the exterior of the motor housing 48. The tack weld serves mainly to hold the filter screen 500 in place until the mounting flange 320 is attached to the motor housing 48.

Figure 14:
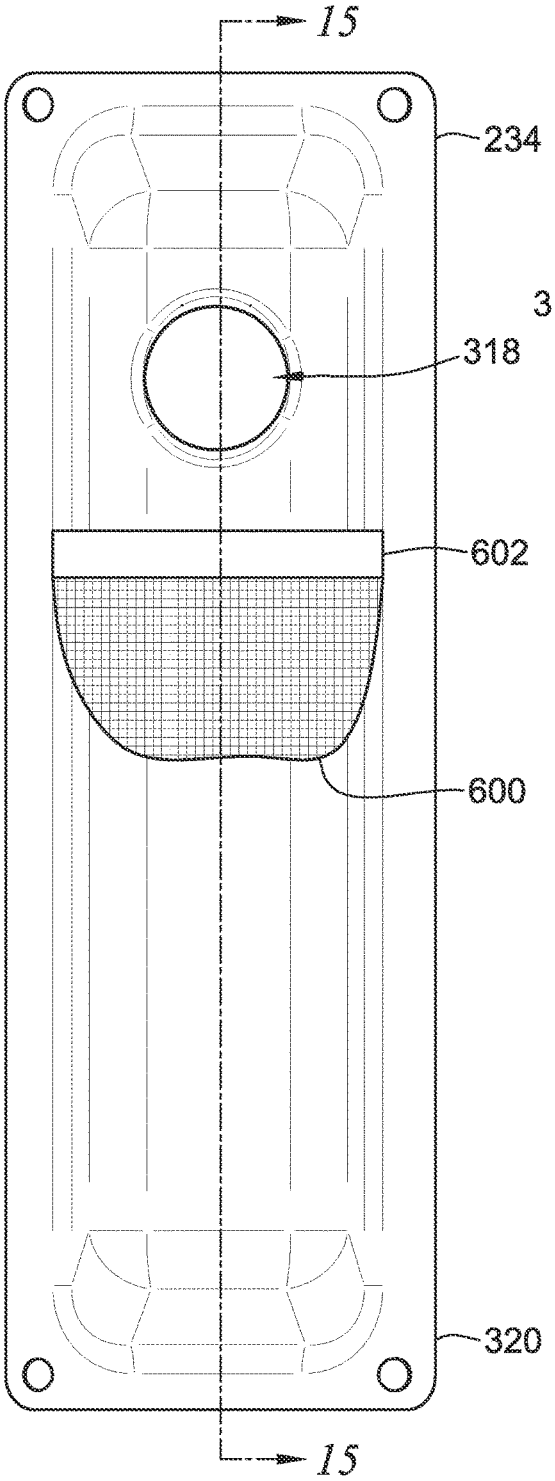
FIGS. 14 and 15 are plan and cross-sectional views of another embodiment of a duct-mounted suction gas filter, according to an embodiment of the invention.
Figure 15:
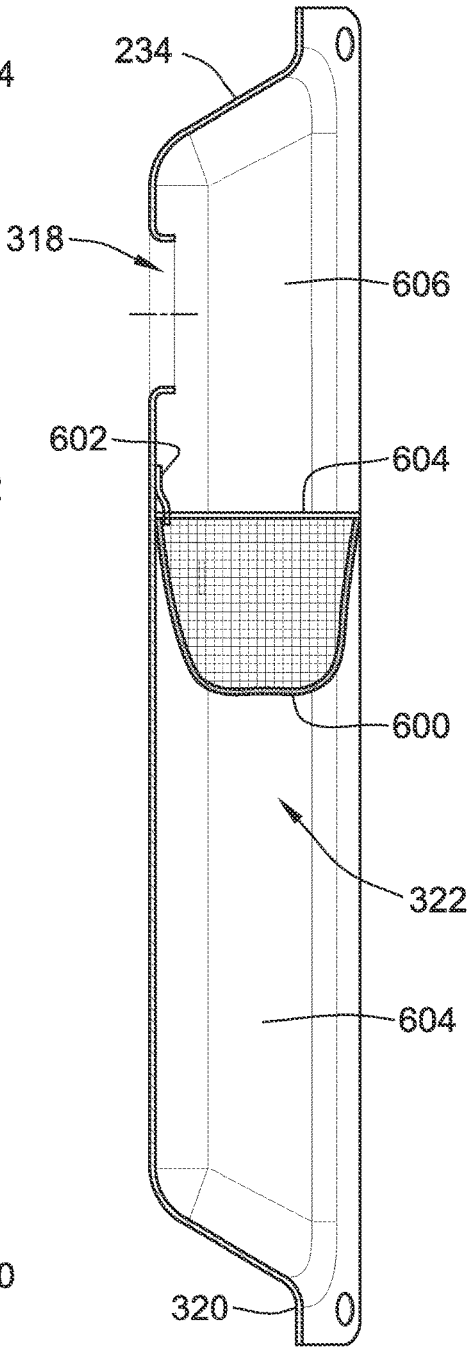

FIGS. 14 and 15 are plan and cross-sectional views of another embodiment of a suction duct and duct-mounted suction gas filter, according to an embodiment of the invention. A cup-shaped filter screen 600 is attached in the duct channel 322 of the suction duct 234 below the duct inlet 318. The filter screen 600 may be stamped into the cup-like and arcuate shape illustrated in FIGS. 14 and 15. The filter screen material should be sufficiently rigid that it retains its cup-like shape during compressor operation. The cup-shaped filter screen 600 has a rim 604 which is attached laterally across a section of the duct channel 322 so as to create a seal between the filter screen 600 and suction duct 234. The rim 604 may be attached to the suction duct 234 using adhesive or by welding, brazing, soldering, etc. A portion of the rim 604 of the filter screen 600 may contact the motor housing 48 (shown in FIG. 1) when the suction duct 234 is attached to the motor housing 48. The strength of that attachment is designed to create a seal between the rim 604 and motor housing 48. Refrigerant gas enters the duct inlet 318 into an upper region 606 of the suction duct 234, and flows down through the duct filter 600. Filtered refrigerant gas then flows from a lower region 604 of the suction duct 234 into an opening in the motor housing 48.

A bracket 602 is attached to the bottom of the duct channel 322. This bracket 602 provides an intermediate assembly aid for assembling the cup-shaped filter screen 600 to the channel bottom 328 of the suction duct 234. The bracket 602 may be welded to the suction duct 234, or attached using an adhesive or mechanical fastener.

Figure 16:
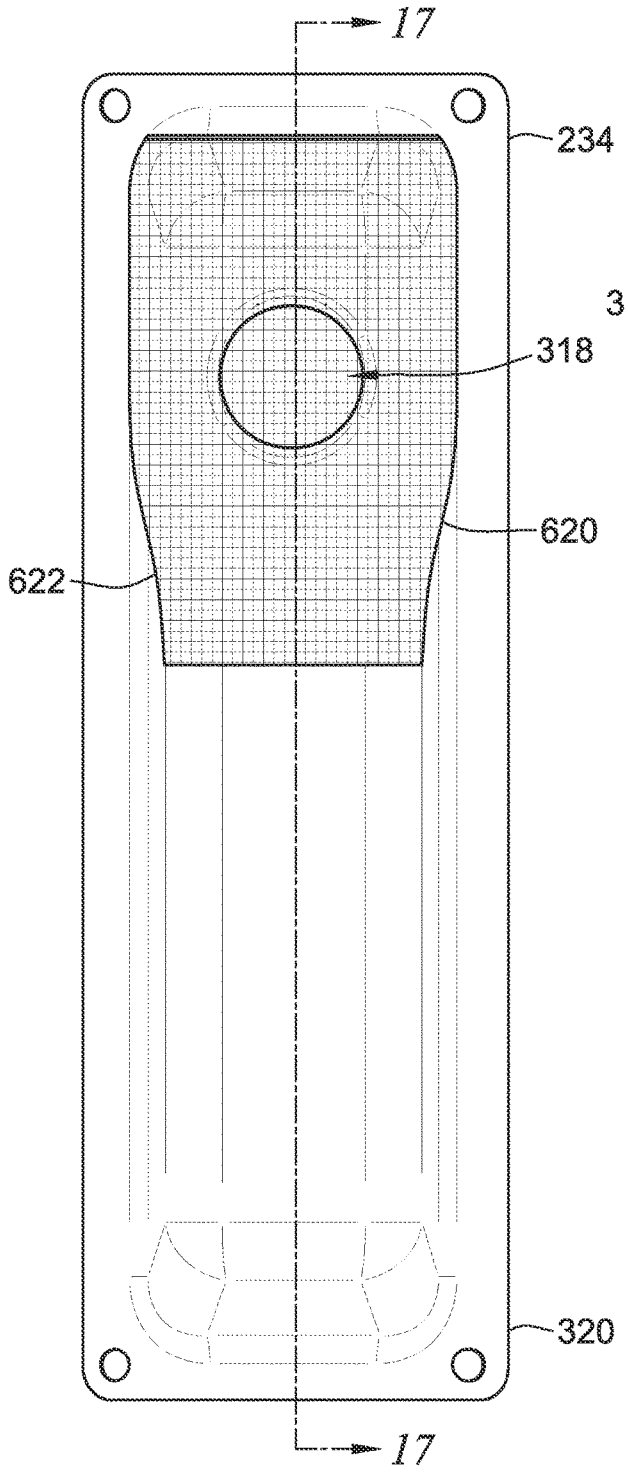
FIGS. 16 and 17 are plan and cross-sectional views of yet another embodiment of a duct-mounted suction gas filter, according to an embodiment of the invention.
Figure 17:
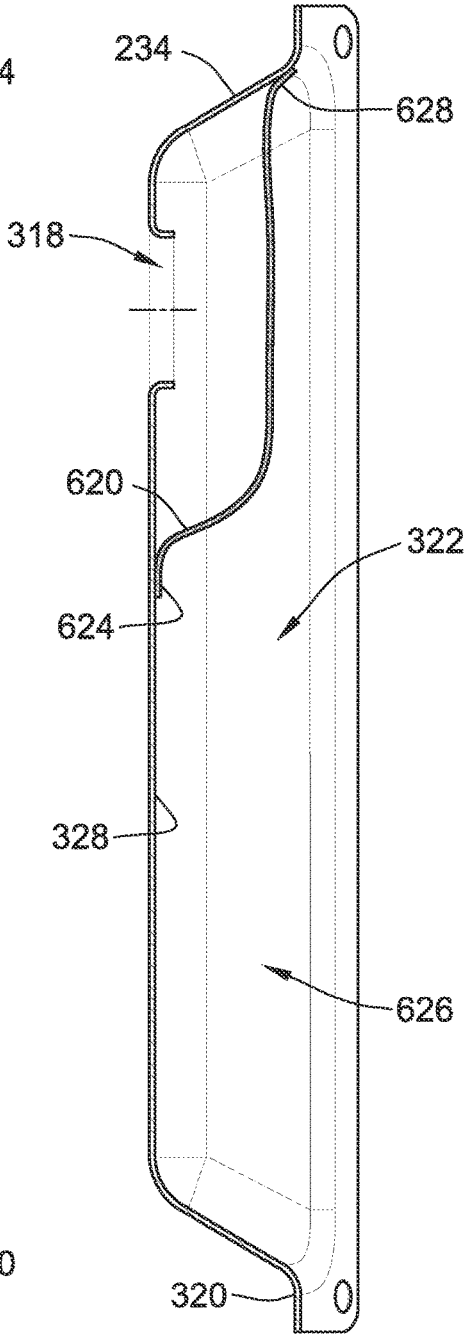

FIGS. 16 and 17 are plan and cross-sectional views of another embodiment of a suction duct and duct-mounted suction gas filter, according to another embodiment of the invention. A filter screen 620 is attached in a portion of the duct channel 322 surrounding the duct inlet 318 such that a bottom portion 624 of the filter screen 620 is sealingly attached to the channel bottom 328, while a top portion 628 of the filter screen 620 is sealingly attached in a part of the duct channel 322 proximate the mounting flange 320. The filter screen 620 may be stamped into a curved and arcuate shape so as to fit easily into the duct channel 322, as shown in FIGS. 16 and 17. The filter screen material should be sufficiently rigid such that, once stamped, the shape of the filter screen 620 does not change during compressor operation.

The perimeter 622 of the filter screen 620 may be attached to the interior of the suction duct 234 using adhesive or by welding, brazing, soldering, etc. Refrigerant gas enters the duct inlet 318 and flows across and down through the filter screen 620. Filtered refrigerant gas then flows from a lower region 626 of the suction duct 234 into an opening in the motor housing 48 (shown in FIG. 1).

Figure 18:
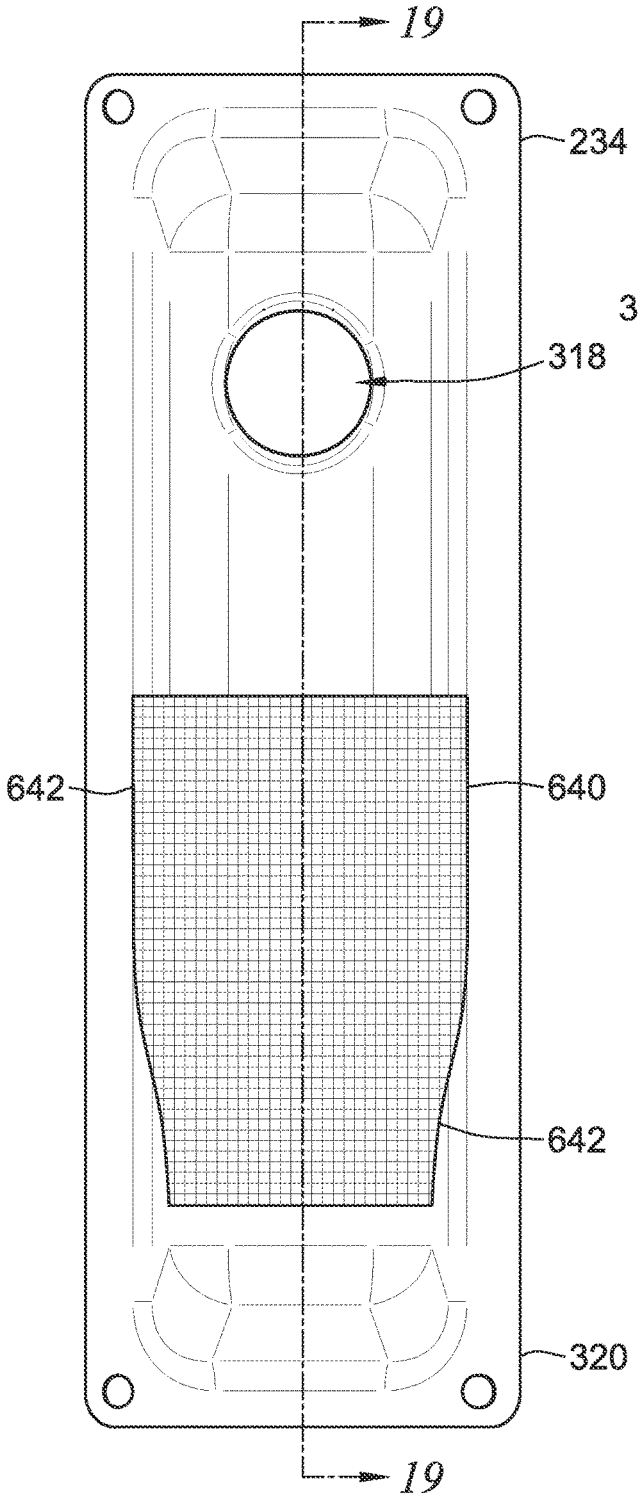
FIGS. 18 and 19 are plan and cross-sectional views of still another embodiment of a duct-mounted suction gas filter, according to an embodiment of the invention.
Figure 19:
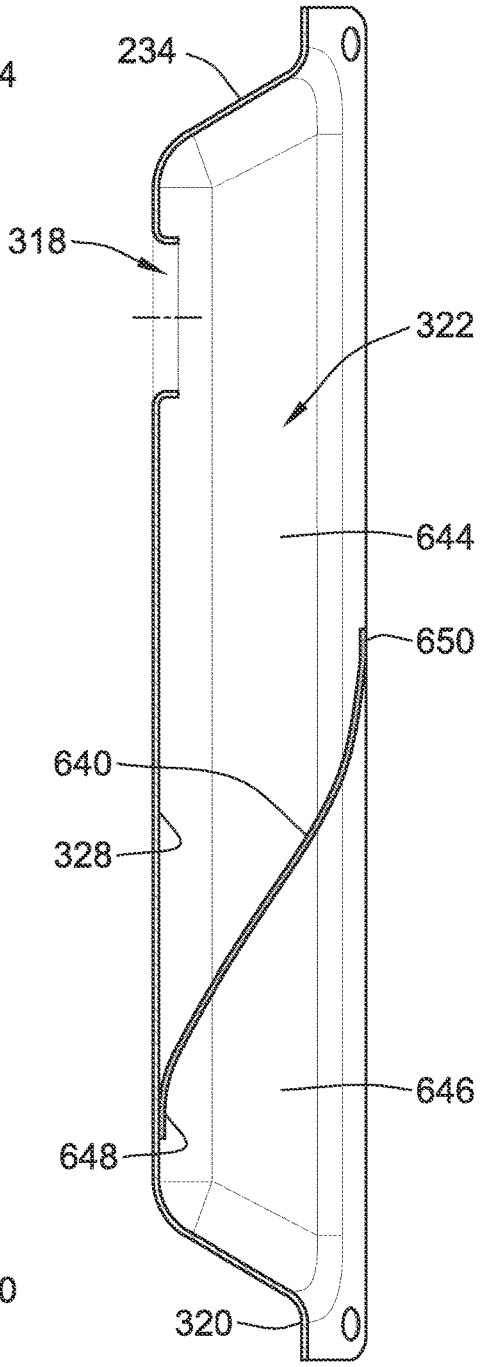

FIGS. 18 and 19 are plan and cross-sectional views of another embodiment of a suction duct and duct-mounted suction gas filter, according to still another embodiment of the invention. A filter screen 640 is attached in a portion of the duct channel 322 at an end of the suction duct 234 opposite the end with the duct inlet 318 such that a bottom portion 648 of the filter screen 640 is sealingly attached to the channel bottom 328, while a top portion 650 of the filter screen 640 is sealingly attached in a part of the duct channel 322 proximate the mounting flange 320. This top portion 650 is designed to seal against the motor housing 48 (shown in FIG. 1) when the suction duct 234 is attached to the motor housing 48. The filter screen 640 may be stamped into a curved and arcuate shape so as to fit easily into the duct channel 322, as shown in FIGS. 18 and 19. The filter screen material should be sufficiently rigid such that, once stamped, the shape of the filter screen 640 does not change during compressor operation.

The perimeter 642 of the filter screen 640 may be attached to the interior of the suction duct 234 using adhesive or by welding, brazing, soldering, etc. Refrigerant gas enters the duct inlet 318 into an upper region 644 of the suction duct 234 and flows down through the filter screen 640 into a lower region 646 of the suction duct 234. Filtered refrigerant gas then flows from the lower region 646 into an opening in the motor housing 48 (shown in FIG. 1).

Figure 20:
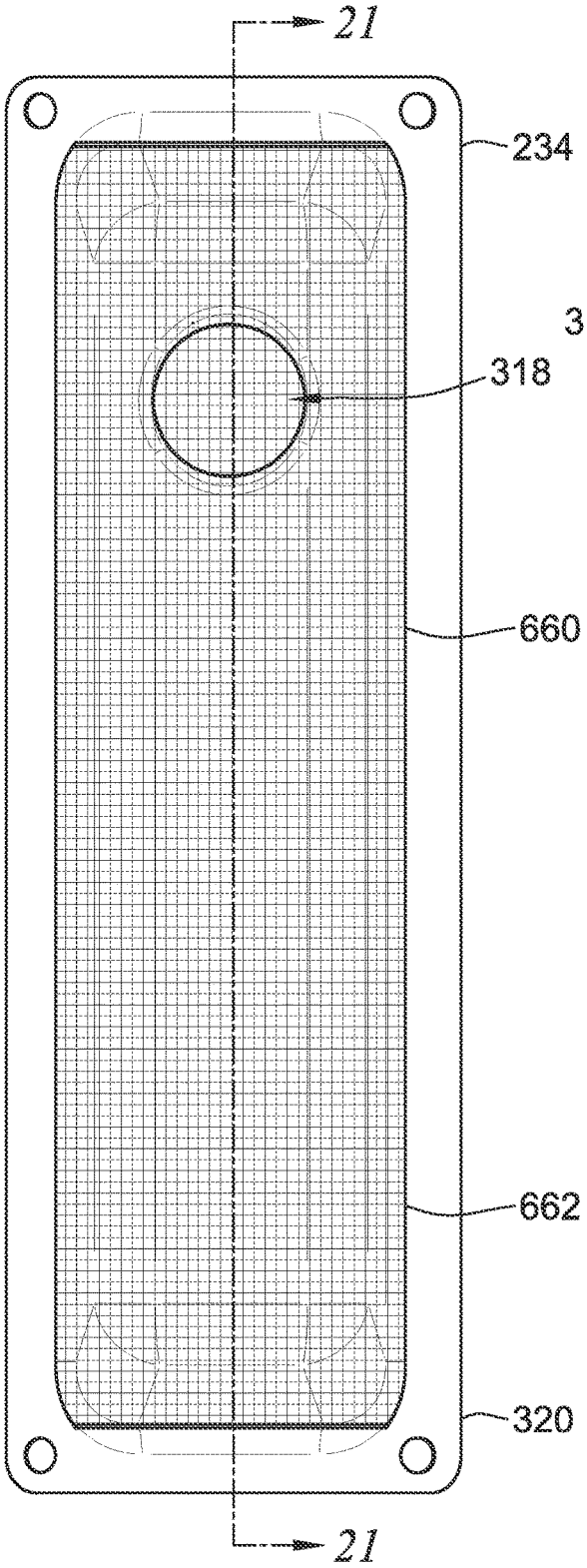
FIGS. 20 and 21 are plan and cross-sectional views of yet another embodiment of a duct-mounted suction gas filter, according to an embodiment of the invention.
Figure 21:
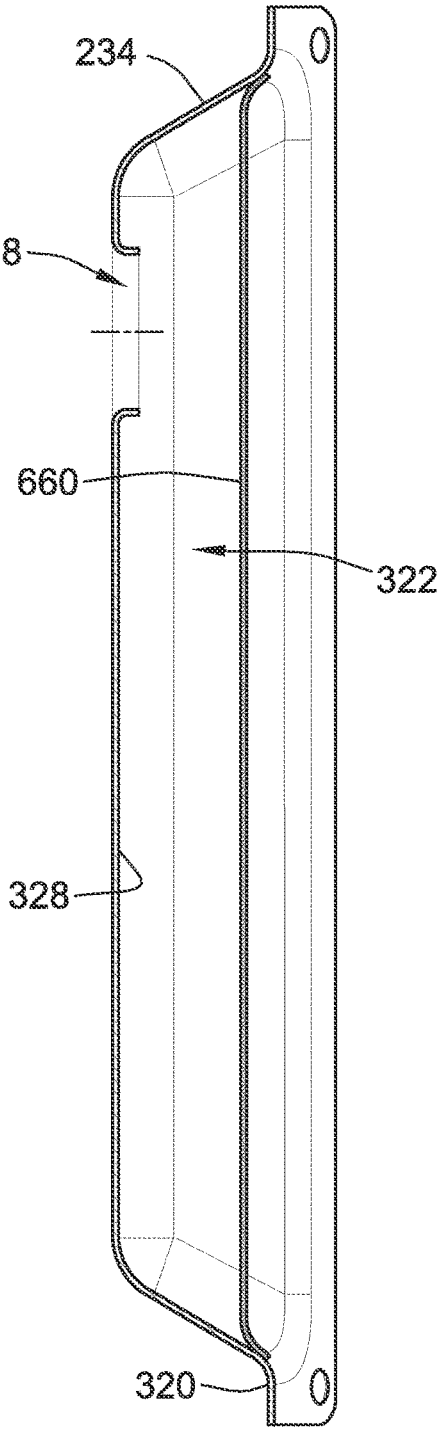

FIGS. 20 and 21 are plan and cross-sectional views of another embodiment of a suction duct and duct-mounted suction gas filter, according to yet another embodiment of the invention. A filter screen 660 is attached so as to cover all, or substantially all, of duct channel 322. The filter screen 660 is sealingly attached to the duct channel 322 proximate the mounting flange 320. The filter screen 660 may be stamped into an arcuate shape so as to cover the duct channel 322 as shown in FIGS. 20 and 21. The filter screen 660 may be slightly curved at its perimeter 662 to facilitate attachment to the duct channel 322. However, other than this slightly curved perimeter portion, the filter screen 660 runs parallel to the channel bottom 328. The filter screen material should be sufficiently rigid such that, once stamped, the shape of the filter screen 660 does not change during compressor operation.

The filter screen 660 may be attached to the interior of the suction duct 234 using adhesive or by welding, brazing, soldering, etc. The filter screen 660 is recessed so that it extends slightly into the interior of suction duct 234 so that the filter screen 660 does not contact the motor housing 48 (shown in FIG. 1) when the suction duct is attached to the motor housing 48. Refrigerant gas enters the duct inlet 318. The gas can largely fill the duct channel 322 before flowing across the filter screen 660, and then into an opening in the motor housing 48.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A compressor for compressing fluid, the compressor comprising:

a housing having a housing inlet for receiving fluid and a housing outlet for discharging the fluid;

a compressing mechanism adapted to compress the fluid toward the housing outlet, the compressing mechanism disposed in the housing;

a drive unit operatively connected to the compressing mechanism for driving the compressing mechanism to compress fluid;

a suction duct disposed in the housing and extending vertically downward from the housing inlet toward a sump defined in the housing, the suction duct configured for attachment to a motor housing, the suction duct having a duct inlet fluidically connected with the housing inlet, the suction duct defining a passage fluidically connecting the duct inlet to an interior cavity of the housing; and a suction gas filter disposed in the suction duct, and having a filter screen positioned downstream of the duct inlet.

2. The compressor of claim 1, wherein the suction duct has an outer generally rectangular and arcuate mounting flange surrounding a duct channel that has been formed into the body and extends between a top end and a bottom end, wherein the duct channel and mounting flange define the interior volume; and wherein the filter screen has a perimeter which is attached to the mounting flange such that a fluid flowing through the duct inlet to the compressing mechanism must pass through the filter screen when the suction duct is attached to the motor housing.

3. The compressor of claim 2, wherein the filter screen is pre-formed such that the perimeter of the filter screen matches contours of the mounting flange.

4. The compressor of claim 2, wherein the filter screen extends laterally across the entire width of the duct channel, and extends longitudinally across the entire length of the duct channel such that the filter screen divides an interior volume of the suction duct into two smaller volumes.

5. The compressor of claim 4, wherein the filter screen diagonally divides at least a portion of the interior volume of the suction duct.

6. The compressor of claim 2, wherein the filter screen is sealingly attached, along its perimeter, to the duct channel of the suction duct.

7. The compressor of claim 6, wherein the filter screen extends across the length and width of the duct channel, and runs parallel to a channel bottom of the suction duct.

8. The compressor of claim 6, wherein the filter screen extends across the width of the duct channel and across a portion of the duct channel length such that the filter screen divides an interior volume of the suction duct into two smaller volumes.

9. The compressor of claim 6, wherein the filter screen is cup-shaped and has a rim that is attached to the duct channel, and wherein a portion of the rim abuts the motor housing when the suction duct is attached to the motor housing.

10. The compressor of claim 1, wherein the filter screen comprises a cylindrical screen member having a vertically-extending axis.

11. The compressor of claim 10, further comprising a partition extending laterally across an interior volume of the suction duct, the partition extending to the motor housing, the partition dividing the interior volume into an inlet region that includes the duct inlet, and an outlet region, the suction gas filter extending into the outlet region, the partition defining a filter inlet opening.

12. The compressor of claim 10, wherein the cylindrical screen member has an inlet end and an outlet end, with an open end at the inlet end and a closed end cap at the outlet end.

13. The compressor of claim 10, wherein the suction gas filter has an opening defined by an opening in the partition.

14. The compressor of claim 1, wherein the compressor is a scroll compressor having an output of at least 0.2 cubic meters per minute, and wherein the suction gas filter comprises a screen body with pores of between 0.25 and 2.0 square millimeters, the screen body defining an effective screen area of greater than 75 square centimeters.

15. The compressor of claim 1, wherein the suction gas filter is arranged between the duct inlet and a motor housing opening.

16. The compressor of claim 1, wherein the suction gas filter has a longitudinal axis that is parallel to a longitudinal axis of the suction duct.

17. The compressor of claim 16, wherein the longitudinal axes of the suction duct and suction gas filter are parallel to a longitudinal axis of the compressor.

18. The compressor of claim 1, wherein the suction gas filter comprises a metal screen.

19. The compressor of claim 1, wherein the compressor is a scroll compressor with scroll bodies having respective bases and respective scroll ribs that project from the respective bases and which mutually engage about an axis for compressing fluid.

20. The compressor of claim 1, wherein the compressor is a scroll compressor having an output of at least 0.2 cubic meters per minute, and wherein the suction gas filter comprises a screen body with pores of between 1.0 and 2.0 square millimeters, the screen body defining an effective screen area of greater than 150 square centimeters.

21. The compressor of claim 1, wherein the filter screen is detached from the duct inlet.

* * * * *